United States Patent [19]

Canjar

[11] 4,028,835

[45] June 14, 1977

[54] TRIGGER MECHANISM FOR RIFLES

[75] Inventor: Mathew H. Canjar, Denver, Colo.

[73] Assignee: M.H. Canjar Company, Denver, Colo.

[22] Filed: Aug. 8, 1975

[21] Appl. No.: 603,128

[52] U.S. Cl. ..... 42/69 R

[51] Int. Cl.[2] ..... F41C 19/00

[58] Field of Search ..... 42/69 R, 69 B, 41, 42 R, 42/70 F, 70 R

[56] References Cited

UNITED STATES PATENTS 3,863,375 2/1975 Browning ..... 42/69 R

*Primary Examiner*—Charles T. Jordan

*Attorney, Agent, or Firm*—Edwin L. Spangler, Jr.

[57] ABSTRACT

This invention relates to a trigger mechanism for rifles wherein a tooth on the hammer engages an opposed cam surface on the sear when the trigger is actuated so as to use the bias of the hammer spring to retract the sear far enough for the tooth to pass by a notch on the latter thus enabling the hammer to strike the firing pin. This same tooth and a notch on the front face of the sear coact upon actuation of the trigger with a controlled release of the hammer to enterengage and lock the hammer in a "half-cock" position before it reaches the firing pin. The sear floats loosely on its pivot and includes another cam surface which coacts with the hammer tooth when the hammer is cocked to move the sear out of the way of the trigger thus permitting the hammer to reach fully-cocked position.

4 Claims, 7 Drawing Figures

TRIGGER MECHANISM FOR RIFLES

All production rifles are equipped with a standard trigger mechanism designed by the manufacturer and installed at the factory which are entirely adequate for the average shooter; however, there are many riflemen and women that demand a better "action" out of the trigger than is present in the "off-the-shelf" model. This is especially true of those shooters who engage in match competition where excellent marksmanship is essential. The shortcomings of the "stock" trigger mechanisms usually consist of such things as non-uniform pull (creep and backlash), overtravel, lost motion, etc. The result of all this is that a considerable market exists for specially-designed trigger mechanisms that offer the highly discriminating shooter the uniformity, reliability, adjustability and safety he or she demands of their rifle.

The trigger mechanism forming the subject matter of the instant invention not only provides a uniform pull coupled with a great deal of adjustability by means of which it can easily be adapted to the requirements of a particular shooter but, in addition, it incorporates a unique "half-cock" safety which is manually actuated by pulling the trigger and releasing the hammer slowly toward the firing pin and, most importantly, which is automatically by-passed during a normal firing sequence. This half-cock safety establishes a mechanical interlock between the hammer and sear that is absolutely secure during normal use as well as all but the most severe abnormal use.

In fully-cocked position, the trigger itself is spring-biased forwardly about its pivot until the rearwardly-facing hook located above the latter contacts the forwardly-facing hook of the sear to hold it in releasable engagement with the hammer when retracted. Pulling the trigger unlocks the sear so that the hammer spring becomes operative to override the sear return spring and retract the toe of the sear from behind a shoulder on the hammer, whereupon, the hammer is free to move against the firing pin were it not for the fact that the hammer tooth would catch in the half-cock notch in the sear. In order to prevent this from happening during a normal firing sequence, the sear is provided with a cam surface engageable by the hammer tooth as it moves forwardly along toward the toe of the sear, this cam surface and tooth cooperating to literally fling the sear out of the way far enough and for a sufficient time interval to permit the tooth to move on past the half-cock notch therein. As the hammer moves from uncocked to fully-cocked position, its tooth engages another cam surface on the sear and moves it out of the way of the trigger due to the fact that the sear is loosely mounted on its pivot.

It is, therefore, the principal object of the present invention to provide a novel and improved trigger mechanism for rifles.

A second objective is the provision of a device of the type aforementioned which includes a half-cock safety and a unique mechanism operatively associated therewith for automatically by-passing same during a normal firing sequence.

Another object of the invention herein disclosed and claimed is to provide a rifle trigger which incorporates all the desired operating characteristics demanded by sophisticated shooters without sacrificing any of the safety features.

Still another objective is to provide a trigger mechanism which, while designed for use in a specific rifle, could easily be adapted for retrofitting into certain other rifles having similar hammer-type actions.

An additional object of the within described invention is to provide a half-cock safety that automatically engages when the trigger is actuated and the hammer is released at a controlled rate yet which is rendered completely inoperative when the trigger is pulled to release the hammer into engagement with the firing pin from a fully-cocked position solely under the influence of the hammer spring.

Further objects are to provide a rifle trigger mechanism that is simple, rugged, dependable, compact, lightweight, versatile and even somewhat decorative in appearance.

Other objects will be in part apparent and in part pointed out specifically hereinafter in connection with the description of the drawings that follows, and in which.

Figure 2:
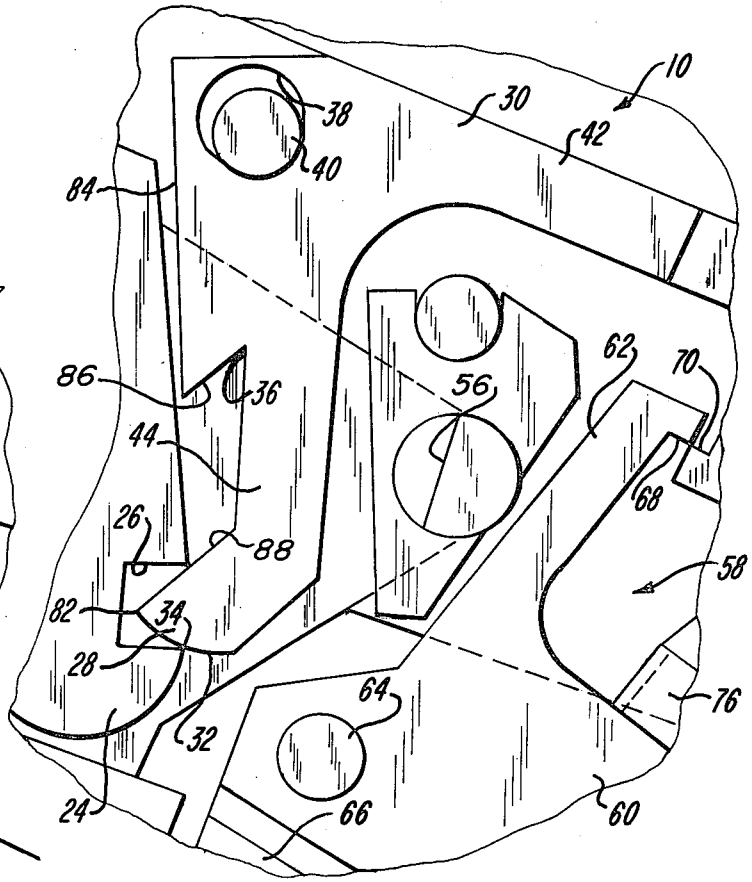
FIG. 2 is a further enlarged fragmentary detail showing the functionally interrelated parts of the trigger, sear and hammer of FIG. 1.
Figure 1:
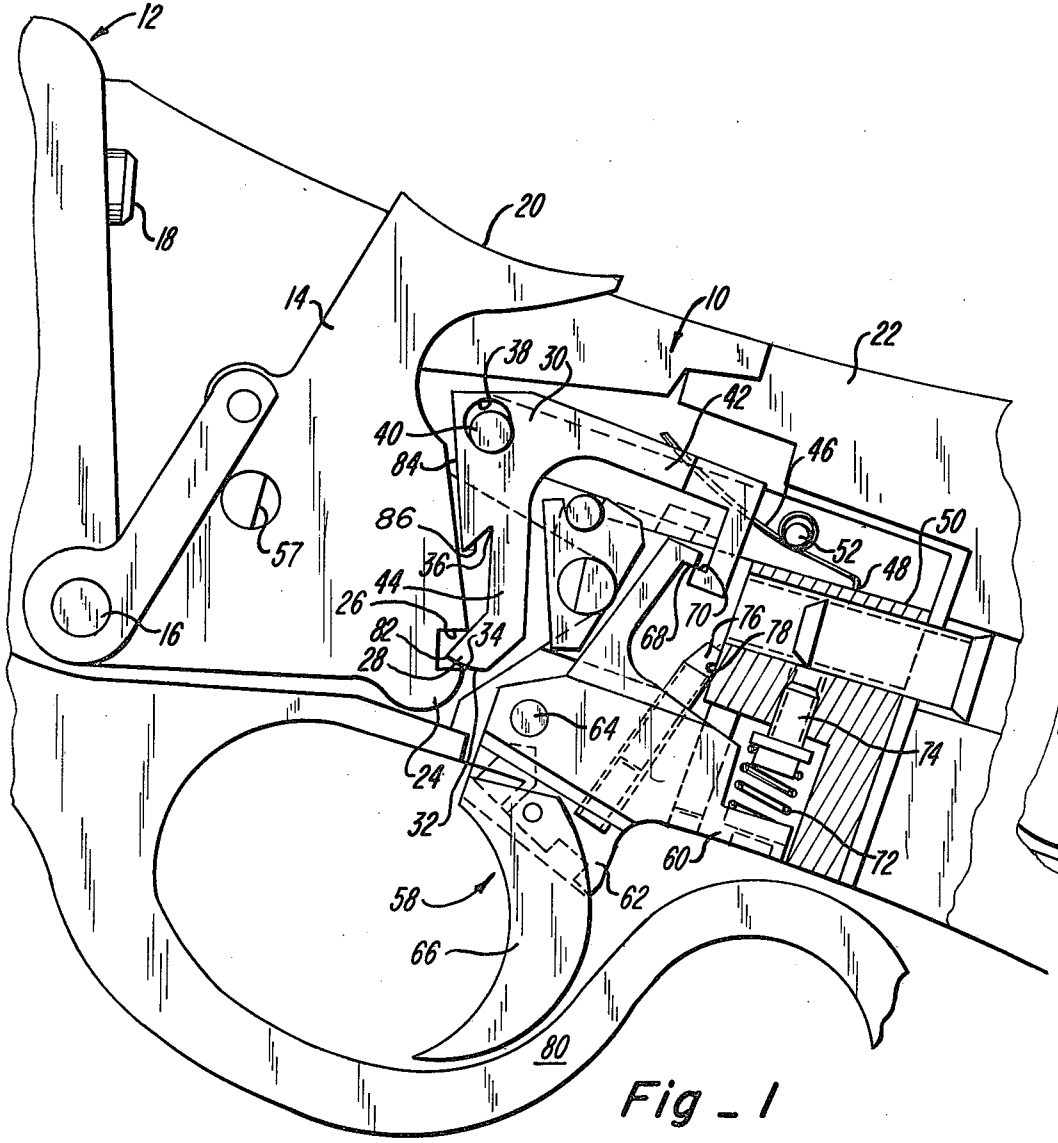
FIG. 1 is a fragmentary side elevation showing the trigger mechanism of the present invention installed in a rifle, portions of the latter having been broken away to more clearly reveal the action.

Referring next to the drawings for a detailed description of the present invention and, initially, to FIGS. 1 and 2 for this purpose, reference numeral 10 has been chosen to represent the trigger mechanism broadly and numeral 12 to similarly designate the rifle in which it is mounted. Rifle 12 is of the hammer-type as opposed to a bolt action, automatic or other style and, as such, it includes a hammer 14 mounted on pivot 16 for movement between the fully-cocked position of FIGS. 1 and 2, the half-cocked safety position of FIG. 6, and the uncocked or "fired" position of FIG. 5 where in it has struck the firing pin 18 that forms a part of the rifle's so-called "action." The hammer 14 is also a part of the action and the trigger mechanism integrates therewith as a means for actuating same.

The top surface of the hammer is provided with a thumb rest 20 used in cocking it which, of course, is accessible to the shooter as he or she grips the stock 22 in normal firing position. The lower rear corner of the hammer has a rearwardly-projecting tooth 24 above which is a notch 26 into which the toe 28 of the sear 30 seats in the fully-cocked position. More specifically, the under surface of the sear toe 28 is provided with a convex cam surface 32 which coacts in a unique way that will be outlined in detail presently with the corner 34 of the tooth in sliding engagement therewith when the hammer moves from its fully-cocked position toward fired position.

The sear has a forwardly-facing notch 36 in its front edge immediately above and adjacent to its toe 28 which, for purposes of the present description will, on occasion, be denominated the "half-cocked notch" to distinguish it from notch 26 in the hammer. Sear 30 has an oversize opening 38 therein which loosely fits over pivot 40 as shown and enables the sear to move downwardly and rearwardly the distance necessary to clear the trigger as the hammer is cocked. Actually, opening 38 is shaped to make almost 180° contact with the lower half of pivot pin 40 against which it is firmly biased by the hammer spring in both fully-cocked and half-cocked position.

Sear 30 has the general form of a dogleg crank having a horizontally-disposed arm 42 and a more or less vertically-disposed one 44, the latter having the half-cock notch and downwardly and forwardly projecting toe 28. Its axis of pivotal movement defined by pivot 40 is located between the angularly-disposed arms 42 and 44 thereof as shown. A sear return spring 46 with one end 48 resting atop a fixed abutment 50 is looped at a point intermediate its ends around a post 52 before extending forwardly into engagement with the horizontal arm 42 of the sear. This sear return spring 46 normally biases the sear clockwise about its pivot 40. When out of contact with the hammer, the sear actually "floats" on pivot 40 as shown in FIGS. 3 and 4.

Figure 3:
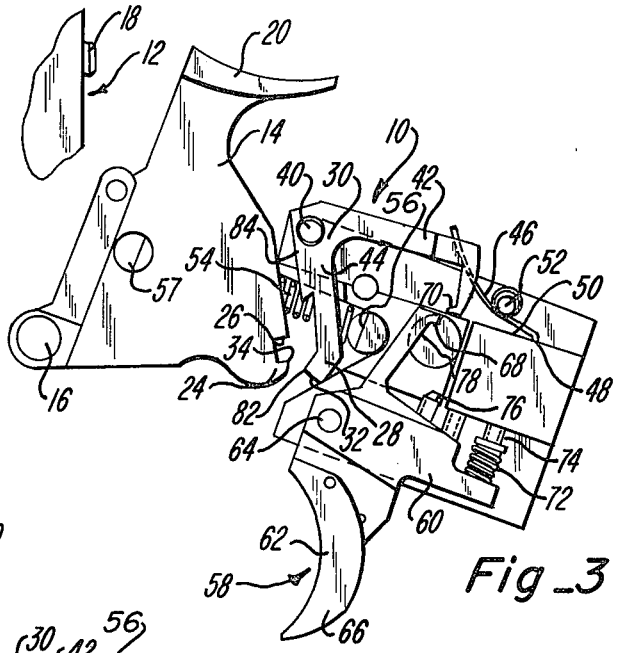
FIG. 3 is a side elevation of just the trigger mechanism, firing pin and hammer to a reduced scale in the positions the elements thereof would occupy just after the hammer tooth has left the cam surface on the sear and has functioned to fling the latter back into a momentary inoperative position.
Figure 4:
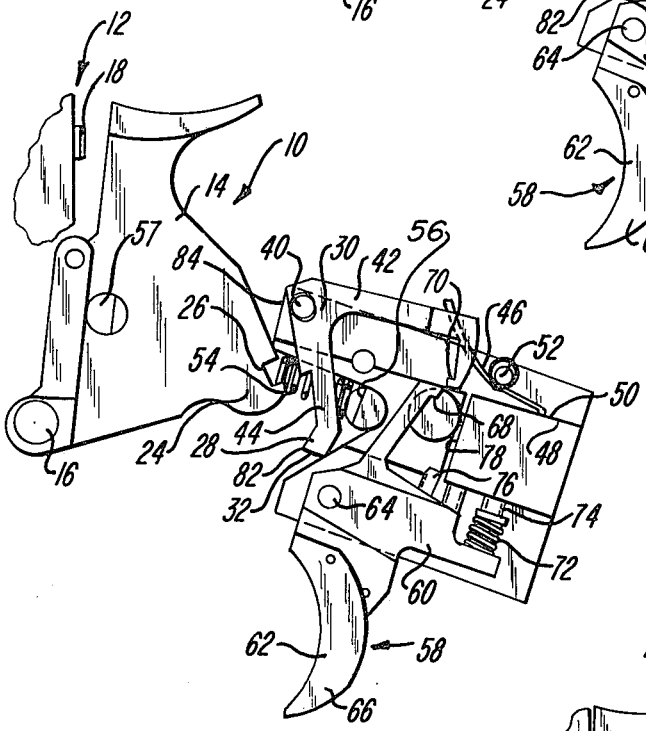
FIG. 4 is a view like FIG. 3 and to the same scale showing the hammer tooth just passing the half-cock notch in the sear.
Figure 5:
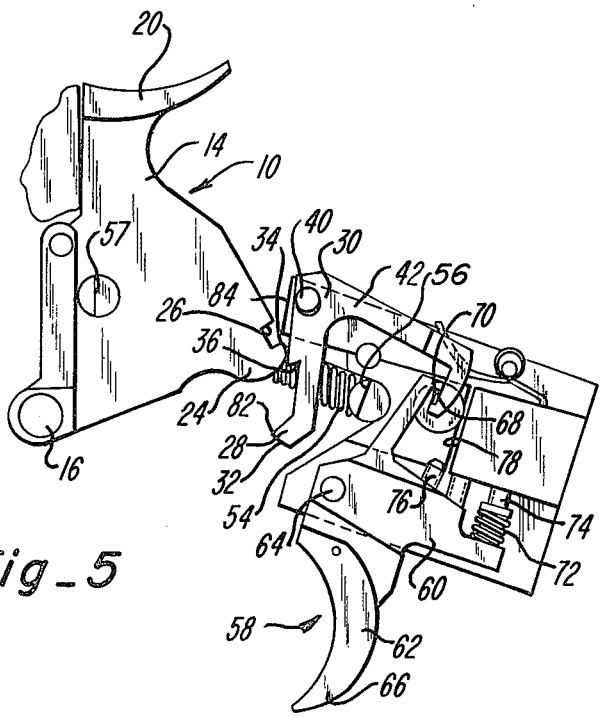
FIG. 5 is a view like FIGS. 3 and 4 and to the same scale showing the hammer in fully fired position against the firing pin and the sear returned into engagement with the hammer by the sear return spring.

Hammer 14 is normally urged in a counterclockwise direction about its pivot 16 by hammer spring 54 (FIGS. 3, 4 and 5). The rear end of hammer spring 54 is in engagement with fixed abutment 56 of the rifle's action while the front end engages a suitable abutment 57 on the hammer. Actually, a pair of hammer springs are used, one on each side of the hammer; however, the near one has not been shown in the drawings as it would obscure key elements of the mechanism. These hammer springs are operative and effective to force the hammer against the firing pin with enough force to fire a shell in the chamber of the rifle. The relative forces exerted upon the hammer and sear by their respective springs are such that hammer spring 54 can easily override sear return spring 46 which it does as soon as the trigger is actuated to release the sear into its retracted position where it is flung or pushed by the advancing hammer.

The trigger has been broadly designated by reference numeral 58 and it will be seen to comprise a generally T-shaped structure, the stem portion 60 of which lays more or less horizontally while the crossbar portion 62 runs up and down. The trigger is pivotally mounted on pivot 64 located approximately where the stem portion 60 and crossbar portion 62 intersect one another. The lower half of the crossbar portion 62 comprises the so-called "trigger shoe" 66 while the upper half is shaped to form a rearwardly-extending hook 68 that hooks over or otherwise engages the forwardly-extending hook 70 that projects downwardly from the rear end of the horizontally-disposed arm 42 of sear 30. A compression spring 72 mounted between the stem portion 60 of the trigger 58 and fixed abutment 74 normally biases the trigger clockwise such that trigger hook 68 locks over or otherwise engages sear hook 70 in the manner shown in FIGS. 1 and 2. As the hammer is cocked against the action of hammer spring 54, the sear return spring 46 will turn the sear clockwise about its pivot 40 until the toe 28 thereof drops into notch 26 in the hammer, whereupon, trigger spring 72 will move trigger hook 68 back into engagement with sear hook 70 so that horizontally-disposed arm 42 of the sear cannot lift up and release the hammer. The hammer spring 54 also acts through the tooth of the hammer to engage cam surface 32 on the bottom of the sear and lift it up until its pivot pin 40 seats tightly in the bottom of oversize opening 38 as shown in FIG. 1. The extent to which the trigger hook 68 hooks over the sear hook 70 is controlled by an adjustable stop 76 projecting upwardly from the stem 60 of the trigger that engages a fixed abutment 78 within the mechanism. In the particular form shown in FIGS. 1 and 2, near absolute minimal engagement between the sear and trigger hooks is present so that the slightest retraction of the trigger shoe 66 toward the back of trigger guard 80 (FIG. 1) will be sufficient to allow the sear arm 42 to raise up and release the hammer.

As the trigger is actuated, its hook 68 raises up into the broken line position shown in FIG. 1 at which instant the counterclockwise bias exerted upon the hammer 14 by means of hammer spring 54 becomes operative to override the sear return spring 46 and begin to slide the tip or corner 34 of tooth 24 forwardly along cam surface 32 along the bottom of the toe 28 of sear 30. The action then becomes one of essentially "flinging" the sear 30 back out of the way until hammer tooth 24 can get past notch 36 in the sear, such action having been diagrammed in FIG. 7 to which detailed reference will now be made.

When fully cocked, the tip 34 of hammer tooth 24 engages the cam surface 32 on the toe 28 of the sear at point "*a*" and exerts a force thereon along line "A" which is perpendicular to a line or a plane tangent to the cam surface 32 underneath sear toe 28. Line A falls well to the rear of the axis of pivotal movement of sear 30 defined by pivot 40, therefore, the counterclockwise movement of the hammer forwardly toward its fired position (FIG. 5) is effective to also turn the sear counterclockwise and retract the vertical arm 44 thereof against the opposing force exerted thereon by the sear return spring 46. As the tip of hammer tooth 34 moves forwardly along cam surface 32 and rocks the sear rearwardly, the lever arm tending to turn the sear gets longer and longer until ultimately the force directed thereagainst lies along line B just as the corner 34 of the tooth passes the tip 82 on the toe of the sear. Once the corner 34 of the hammer tooth reaches point *b* in the diagram of FIG. 7, it is clear of the toe of the sear but it would not clear the half-cock notch 36 if the sear return spring 46 were strong enough to return the sear to its fully-extending position shown in FIG. 6 as is dramatically evident from the fact that the arc D described by the hammer tooth corner 34 catches the edge of the half-cock notch 36 even with the sear in position C, which position is not nearly as far forward as the fully-extended sear position of FIG. 6. Obviously, the arc D described by hammer 24 must be such as to engage the half-cock notch 36 of the sear when the latter occupies its fully-extended position shown in FIG. 6, otherwise, it would not be possible to place the weapon on "safe" as shown.

Figure 6:
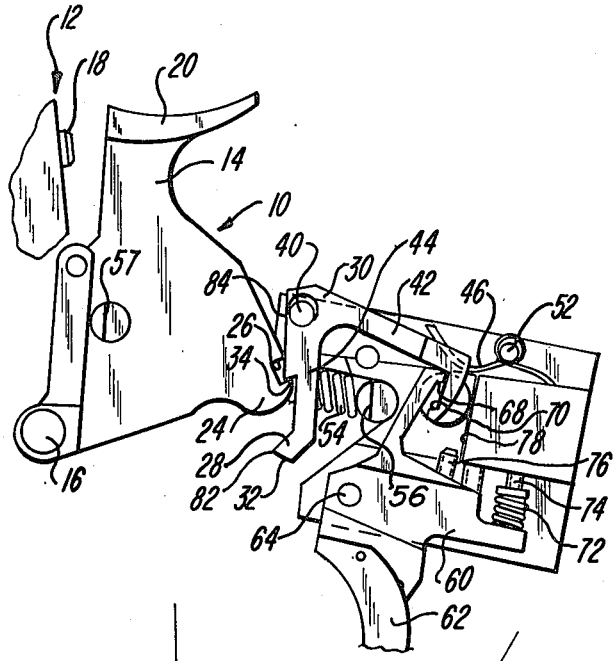
FIG. 6 is a side elevation to the same scale as FIGS. 3–5 showing the hammer and sear in interlocked half-cocked safety position; and, FIG. 7 is a sequential diagram to a greatly enlarged scale showing the relative positions of the sear and hammer tooth as the latter progresses across the cam surface.
Figure 7:
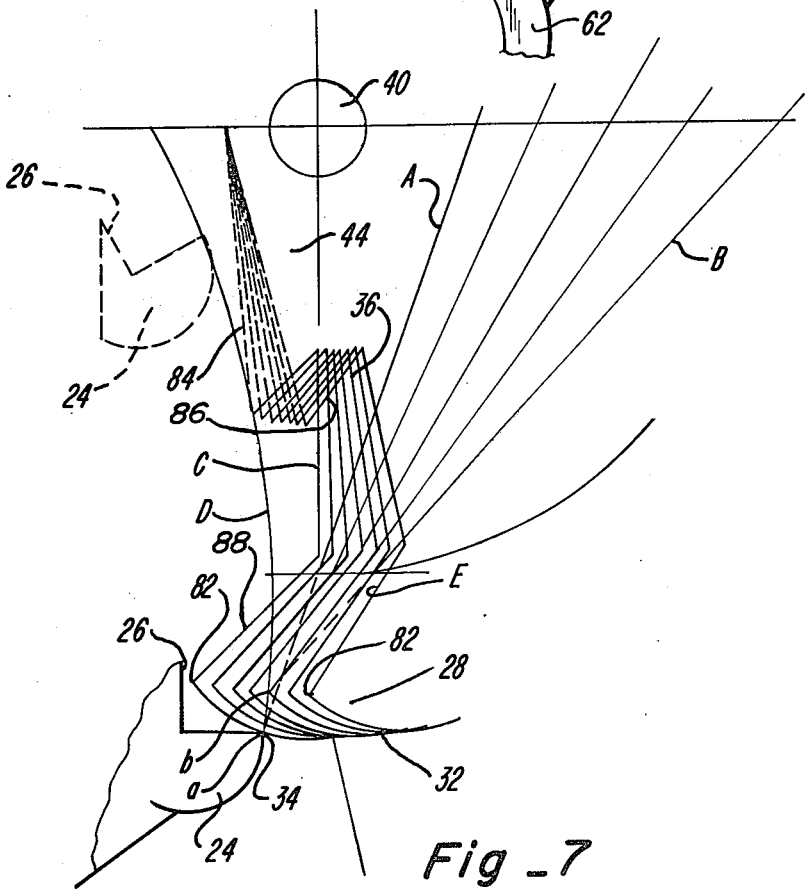

Now, instead of the hammer just barely clearing the toe 82 of the sear when it lies in position *b* of FIG. 7, the movement of the hammer along cam surface 32 is operative to retract the sear all the way back to position E where the corner 34 of the hammer is sure to clear the half-cock notch 36 in the latter before sear return spring 46 can bring it forward into extended position C or the fully-extended position of FIG. 6. The over travel of the sear all the way to position E is the result of a "flinging" action accomplished when the hammer slides up and forwardly along cam surface 32. Of course, once the corner 34 of the hammer has cleared the half-cock notch in the sear, it is free to move on into the fired position represented in full lines in FIG. 5 and broken lines in FIG. 7. In this position, it will have contacted the firing pin 18 with sufficient force to fire a cartridge in the chamber.

Once the hammer occupies the fired position of FIG. 5, it can be actuated into either the half-cocked safety position of FIG. 6 or the fully-cocked position of FIGS. 1 and 2. In moving to the half-cocked "safety" position, the hammer tooth will first slide down along a second cam surface 84 on the front of the sear in the manner shown in FIG. 5 to which detailed reference will now be made along with FIGS. 1 and 2. After the hammer has actuated into fired position, sear return spring 46 is, of course, effective to move the sear into the partially-extended position of FIG. 5. The trigger 62 will have, in the meantime, returned to its extended position shown in FIG. 5 where its hook 68 lies in position to lock over the hook 70 of the sear. Now, as the tooth 24 of the hammer moves down along cam surface 84 from the fired position of FIG. 5 into the half-cocked position of FIG. 6, it will rotate the sear counterclockwise until the tip 34 of the hammer tooth leaves cam surface 84 and drops into half-cock notch 36 under the influence of the sear return spring 46.

This same half-cocked position can, of cource, be reached from the fully-cocked position of FIGS. 1 and 2 by merely actuating the trigger mechanism 58 while holding the hammer back with the thumb and releasing it into extended position slowly. As this occurs, the hammer tooth 24 sliding along the cam surface 32 of the sear will no longer be effective to fling the sear back far enough for the corner 34 of the tooth to clear notch 36. Instead, the sear return spring 46 will continually bias the sear clockwise keeping it engaged with some portion of the hammer until its tooth drops into notch 36 latching the mechanism in "safe" position. With the elements of the mechanism on safe, the trigger itself can be actuated; however, such actuation will not operate the sear to release the hammer into fired position. Furthermore, the hammer cannot be released into fired position without its first being moved into the fully-cocked position of FIGS. 1 and 2.

Now, with the hammer in the half-cock position of FIG. 6, hammer springs 54 tending to turn the hammer counterclockwise about pivot 16 will act through tooth 24 pressing up against shoulder 86 adjacent notch 36 in the sear to raise the latter up until pin 40 seats securely in the lower part of oversize opening 38. As the hammer moves from the fired position of FIG. 5 into the fully-cocked position of FIGS. 1 and 2, it will pass through the half-cock position of FIG. 6, of course, when the user may either leave the action by releasing the hammer before it reaches fully-retracted position or, alternatively, continue on until the mechanism is fully-cocked and ready to fire. In moving from the half-cocked safety position of FIG. 6 into the fully-cocked position of FIGS. 1 and 2, however, the hook 68 on the trigger will engage the hook 70 on the sear and prevent the hammer from ever reaching its fully-cocked position if the sear is mounted for pivotal movement around a fixed axis defined by pivot 40. Accordingly, sear 30 is provided with a third upwardly and forwardly tilted cam surface 88 immediately above toe 28 which is engaged by the tip 34 of the hammer tooth as it moved into fully-cocked position, this third cam surface and hammer tooth tip coacting with one another to move the sear down and to the rear far enough for the hook 68 on the trigger to clear the tooth 70 of the sear and not latch.

The firing sequence of the trigger mechanism can best be seen in FIGS. 1–5 to which reference will now be made. The first step in the firing sequence is, of course, to fully cock the hammer by retracting same into the position of FIGS. 1 and 2 where the trigger hook 68 is engaged with the sear hook 70 as shown and the cam surface 32 of the sear rests against the corner 34 of hammer tooth 24. As the trigger 62 is actuated to release the sear, spring 54 drives the hammer counterclockwise (forwardly) so that the corner of its tooth slides along cam surface 32 of the sear and flings it back to the fully-retracted position E of FIG. 7 (FIG. 3) whereupon the tip of the hammer will by-pass half-cock notch 36 before sear return spring 46 is effective to return the sear to its fully-extended position, such a condition having been illustrated in FIG. 4 where the hammer tooth is moving past the half-cock notch while the sear remains retracted. Finally, in FIG. 5 the hammer has been shown all the way forward in fired position and the sear has also been returned to its full forward position but well after the tooth of the hammer has passed by the half-cock notch therein.

What is claimed is:

1. For use with a rifle action of the type having a trigger mechanism; a firing pin; a hammer mounted for pivotal movement from a cocked position forwardly through a half-cocked position into a fired position against said firing pin, said hammer including a tooth projecting rearwardly from the rear edge thereof and means defining an upwardly-facing ledge above said tooth; and, spring means biasing said hammer forwardly into its fired position, said trigger mechanism comprising: a pivot pin positioned behind the hammer; a sear loosely mounted on said pivot pin for relative movement rearwardly thereof and for pivotal movement from a retracted inoperative position forwardly into either of two extended operative positions, said sear including a forwardly-extending projection positioned and adapted in the first of its forwardly-extended operative positions to engage the upwardly-facing ledge of the hammer and releasably latch the latter in its cocked position, said sear having a forwardly-opening notch positioned and adapted in the second of its forwardly-extended operative positions to receive the tooth of the hammer when in its half-cocked position and prevent the latter from engaging the firing pin, said sear when in its first extended position having a first cam surface in sliding engagement with the tooth of the hammer as the latter moves from its cocked position toward its fired position, and said sear including a second cam surface located beneath the notch therein positioned for engagement by the hammer tooth upon movement of the hammer from extended into retracted position; a sear return spring connectable to the sear for normally biasing it into one of its extended positions; a trigger mountable for pivotal movement from a released position rearwardly into a triggered position, said trigger being positioned and adapted in its released position to engage the sear in its first extended operative position and prevent retraction thereof, said trigger being operative upon actuation thereof from its released position into its triggered position to disengage said sear for movement from its first extended operative position into its second extended or retracted positions, and said trigger being inoperative in either its released position or its triggered position to retract said sear in the second extended operative position thereof; and, means comprising a trigger spring connectable to the trigger for normally biasing it into its released position, said first cam surface being shaped to coact with the hammer tooth as the latter slides forwardly therealong under the unrestrained bias of the hammer spring to retract said sear far enough and for an interval long enough to permit said hammer tooth to by-pass the notch in said sear before the sear return spring can return said sear to either of its extended positions upon actuation of the trigger with said sear in its first extended operative position, and said second cam surface and hammer tooth coacting upon movement of the hammer from extended into retracted position to move said sear rearwardly relative to its pivot pin into a position where it will by-pass the trigger in triggered position.

2. The trigger mechanism as set forth in claim 1 in which: the hammer spring normally biases the sear against its pivot when said sear lies in either of its extended operative positions.

3. The trigger mechanism as set forth in claim 1 in which: the sear return spring is operative to return the sear to the first of its forwardly-extended operative positions when the hammer tooth becomes disengaged from the second cam surface of said sear as the hammer moves toward its cocked position.

4. For use with a rifle action of the type having a firing pin; a hammer mounted for pivotal movement from a cocked position forwardly through a half-cocked position into a fired position against said firing pin, said hammer including a tooth projecting rearwardly form the rear edge thereof and means defining an upwardly-facing ledge above said tooth; and, spring means biasing said hammer forwardly into its fired position, the trigger mechanism which comprises: a sear mountable behind the hammer for pivotal movement from a retracted inoperative position forwardly into either of two extended operative positions, said sear including a forwardly-extending projection positioned and adapted in the first of its forwardly-extended operative positions to engage the upwardly-facing ledge of the hammer and releasably latch the latter in its cocked position, said sear having a forwardly-opening notch positioned and adapted in the second of its forwardly-extended operative positions to receive the tooth of the hammer when in its half-cocked position and prevent the latter from engaging the firing pin, said sear when in its first extended position having a first cam surface in sliding engagement with the tooth of the hammer as the latter moves from its cocked position toward its fired position, and said sear also having a forwardly-extending hook; a sear return spring connectable to the sear for normally biasing it into one of its extended positions; a trigger mountable for pivotal movement about a point intermediate its ends from a released position rearwardly into a triggered position, said trigger including a rearwardly-extending hook positioned and adapted in triggered position to hook over the forwardly-extending hook of the sear when in its first extended operative position, said hooks when thus interlocked coacting with one another to prevent rotation of the sear from its first extended operative position into its second extended or retracted position, and said trigger being positioned and adapted in its released position to engage the sear in its first extended operative position and prevent retraction thereof, said trigger being operative upon actuation thereof from its released position into its triggered position to disengage said sear for movement from its first extended operative position into its second extended or retracted position, and said trigger being inoperative in either its released position or its triggered position to retract said sear in the second extended operative position thereof; and, means comprising a trigger spring connectable to the trigger for normally biasing it into its triggered position, said first cam surface being shaped to coact with the hammer tooth as the latter slides forwardly therealong under the unrestrained bias of the hammer spring to retract said sear far enough and for an interval long enough to permit said hammer tooth to by-pass the notch in said sear before the sear return spring can return said sear to either of its extended positions upon actuation of the trigger with said sear in its first extended operative position.

* * * * *